United States Patent [19]

Iura et al.

[11] Patent Number: 5,048,133

[45] Date of Patent: Sep. 17, 1991

[54] STRETCHER

[76] Inventors: Tadashi Iura, 172-4, Befu-cho; Yukio Yokohata, 185-1, Befu-cho, both of Matsuyama-shi, Ehime 791; Hisashi Terao, 640-1, Mori, Iyo-shi, Ehime 799-31, all of Japan

[21] Appl. No.: 202,627

[22] Filed: Jun. 6, 1988

[30] Foreign Application Priority Data

Jun. 18, 1987 [JP] Japan ..... 62-153115

[51] Int. Cl.[5] ..... A61G 7/10

[52] U.S. Cl. ..... 5/81 B; 5/86

[58] Field of Search ..... 5/11, 63, 81 R–81 C, 5/86, 88; 296/20

[56] References Cited

U.S. PATENT DOCUMENTS

| | | | |
|---|---|---|---|
| Re. 28,056 | 6/1974 | Stevens . | |
| 1,347,549 | 7/1920 | Mote | 296/20 |
| 2,528,048 | 10/1950 | Gilleland | 5/86 |
| 2,565,761 | 8/1951 | Dean | 5/81 B |
| 2,630,583 | 3/1953 | Gilleland . | |
| 2,665,432 | 1/1954 | Butler | 5/81 B |
| 2,668,301 | 2/1954 | Brouillette . | |
| 2,733,452 | 2/1956 | Tanney | 5/81 B |
| 2,834,030 | 5/1958 | Jones | 5/81 R |
| 2,905,952 | 9/1959 | Reichert et al. . | |
| 3,015,114 | 1/1962 | Seib . | |
| 3,099,020 | 7/1963 | Garfield et al. . | |
| 3,304,116 | 2/1967 | Stryker | 5/81 R X |
| 3,493,979 | 2/1970 | Koll et al. . | |
| 3,541,617 | 11/1970 | Clanan . | |
| 3,593,351 | 7/1971 | Dove | 5/81 R |
| 3,765,037 | 10/1973 | Dunkin . | |
| 3,786,523 | 1/1974 | Sele . | |
| 3,967,328 | 7/1976 | Cox . | |
| 4,077,073 | 3/1978 | Koll et al. . | |
| 4,087,873 | 5/1978 | Ohkawa . | |
| 4,259,756 | 4/1981 | Pace . | |
| 4,262,375 | 4/1981 | Lilienthal . | |
| 4,631,761 | 12/1986 | Lederman | 5/86 |
| 4,761,841 | 8/1988 | Larsen | 5/81 B X |
| 4,794,655 | 1/1989 | Ooka et al. | 5/81 B X |
| 4,858,261 | 8/1989 | Iura | 5/81 B |

FOREIGN PATENT DOCUMENTS

| | | | |
|---|---|---|---|
| 1958781 | 3/1971 | Fed. Rep. of Germany | 5/86 |

*Primary Examiner*—Michael F. Trettel

*Attorney, Agent, or Firm*—Armstrong, Nikaido, Marmelstein, Kubovcik, & Murray

[57] ABSTRACT

A wheeled stretcher for transferring and carrying a person lying on a bed, such as an invalid, is shown wherein the height of the stretcher is low enough to go under the bed. A lifting device narrower than the width of the wheeled stretcher is provided in the middle but at a position offcenter in a transversal direction of the wheeled stretcher which can be moved in both longitudinal and transversal directions. A bed frame is attached to the top of the lifting device at approximately the center of the wheeled stretcher, and a bed mat is placed on the bed frame. The surface of the mat is covered with a transfer sheet which can be moved across the bed mat. To transfer a person lying on a bed onto the wheeled stretcher, the stretcher is placed beside the bed, the bed frame is once lifted over the bed, then is lowered onto the bed. Then the transfer sheet is moved to a side of the lying invalid person who is then put onto the sheet. The sheet is then moved to the original position at the center of the bed mat. With the lifting device which moves the bed frame up and down positioned to either the right or left side, the bed frame can be overlapped deeply with the bed.

7 Claims, 13 Drawing Sheets

STRETCHER

BACKGROUND OF INVENTION

The present invention relates to a wheeled stretcher used to transfer a person lying on a bed such as an invalid, a bed-ridden elderly, or a physically handicapped person.

A wheeled stretcher having a patient transfer belt as disclosed in the Japanese Patent Publication No. Sho. 51-60192 has commonly been known. There, the width of the cart of the wheeled stretcher supporting the bed frame is approximately the same as the width of the bed frame.

A wheeled stretcher having a support at either the left or right side of the cart and a foldable stretcher opposite the support and mounted so as to be lifted and lowered has also been proposed, as disclosed in the Japanese Patent Publication No. Sho. 55-19531.

With these conventional wheeled stretchers, however, it is not possible to place the bed frame onto a bed close to the person lying on the bed or to transfer the person lying on the bed mat atop the bed frame by laying a transfer sheet under the person. Even if the bed frame could be overlapped onto the bed, it is difficult to transfer the person lying on the bed onto the bed mat as there is no transfer sheet to transfer the person lying on the frame easily onto the bed mat.

For improvement of such conventional arts, the applicants of the present invention have already several inventions which are now applying for Japanese and U.S. patents. The application numbers are Patent Application Sho. 57-145161, Sho. 57-201716, Sho. 58-053181, Sho. 57-201716, and Sho. 120356 for the Japanese patents and U.S. Pat. No. 590,745 for the U.S. patent.

The movable bed vehicle of the U.S. Patent has an elevator outside the truck at either the left or right side. It is disadvantageous in that a person lying on a bed can only be transferred from either the right or left of the bed frame with the elevator standing in the way.

The patents cited in the application include U.S. Pat. Nos. 4,259,756 (PACE), 3,786,523 (SELE), 4,087,873 (OHKAWA), 4,077,073 (KOLL, ET AL.), 3,765,037 (DUNKIN), 3,541,617 (CLAMAN), 3,493,979 (KOLL ET AL.), 2,905,952 (REICHERT ET AL.), 3,015,114 (SEIB), 2,668,301 (BROUILLETTE), 2,528,048 (GILLELAND), 4,262,375 (LILIENTHAL), 3,969,328 (COX), 3,099,020 (GARFIELD), Re. 28,056 (STEVENS), and 2,630,583 (GILLELAND). Among these, U.S. Pat. Nos. 3,786,523 (SELE) and 4,262,375 (LILIENTHAL) are comparatively similar to the present invention. In both cases, however, a patient is placed on a support member having a hard frame and the support member is moved on a rail for transferring the patient. Such devices tend to be intricate and are not easily applicable to beds in general.

SUMMARY OF THE INVENTION

This invention is directed to providing a wheeled stretcher which can transfer a person lying on a bed easily through the improvements of the inventions mentioned above.

The wheeled stretcher according to the present invention has a truck which can be moved in a transversal, longitudinal, or diagonal direction. The height of the stretcher's truck is low enough to go under a bed. Along the longitudinal direction of the truck, a lifting device of a narrow width is positioned offcenter of the truck on either the right or left side and through which a bed frame is supported at approximately the center of the truck. A bed mat is placed on top of the bed frame and a transfer sheet which can be moved in a transversal direction by adequate control is placed onto the bed mat.

To move a person lying on a bed onto the wheeled stretcher, the wheeled stretcher is placed beside the right or left side of the bed. The bed frame is lifted over the bed, then lowered overlapping the bed. The transfer sheet is moved to the lying person, the person is put onto the sheet, and the sheet is moved onto the bed mat on the bed frame. Using the wheeled stretcher according to the invention, a person lying on a bed can be transferred onto the stretcher easily from either the right or left side of the bed. Since the transversal width of the wheeled stretcher can be narrowed, it can easily go through a narrow entrance of a hospital room, and the bed mat can be overlapped with a bed from either side of the bed.

This makes it easier to transfer a person lying on a wide bed. The ratio of deflection of the lifting device to the truck in either the right or left direction should preferably be between 6:4 and 9:1.

DESCRIPTION OF THE PREFERRED EMBODIMENTS

Figure 1:
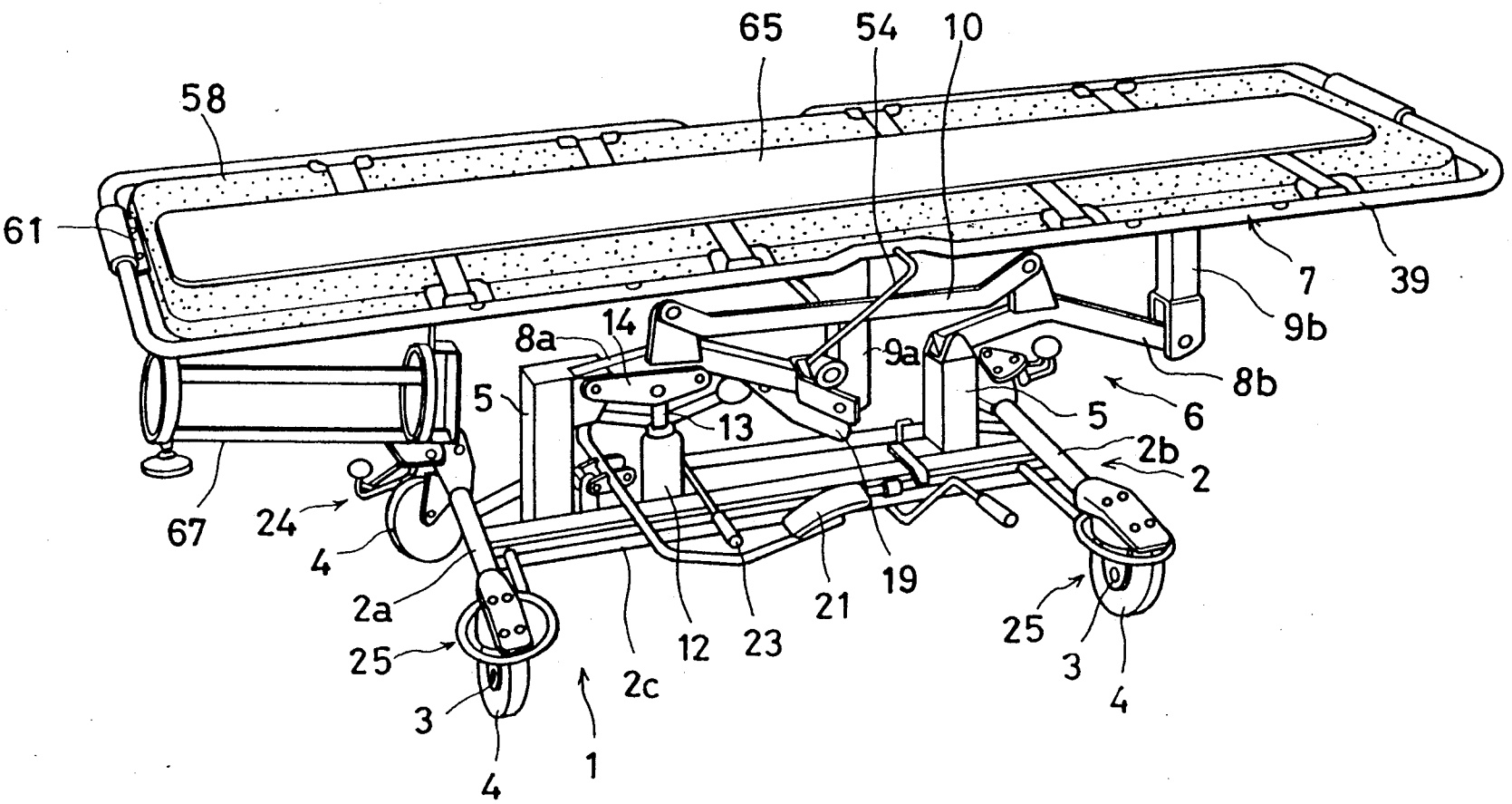
FIG. 1 is a diagonal view of the whole stretcher as embodiment 1 of the present.

The present invention is further illustrated in detail now referring to the drawings.

As shown in FIG. 1, (1) is a movable truck, (2) is a frame formed approximately to an H-shape as seen from a top view with a front frame (2*a*) and a rear frame (2*b*) connected by a longitudinal frame (2*c*) at a position offcenter to either the right or left. Wheels (4) are attached at the four corners of the frame (2) to the caster frames (3) which can turn freely around. The lower supports (5) projecting upward are provided respectively at the front and rear side of the longitudinal frame (2*c*). The base of a parallel link mechanism (6) which can be moved up and down by a lifting mechanism, a jack for example, is connected to the supports (5). Lastly, a bed frame (7) is supported by the parallel link mechanism (6).

Detailed further, the parallel link mechanism (6) has links (8*a*, 8*b*) whose bases are supported by brackets at the top of the supports (5). Support levers (9*a*, 9*b*) which hold the bed frame (7) are connected to the top ends of the links (8*a*, 8*b*) which are connected each other by a connecting link (10).

The parallel link mechanism (6) operated by the piston (13) of a jack (12) is an example of the hydraulic lifting device held by a base (11) and fixed onto the longitudinal frame (2*c*). The base of the link (8*a*) is supported by a pin. A lifting arm (14) which can turn freely around the pin is connected to the piston (13) on the center in a longitudinal direction. The link (8*a*) supported by the lifting arm (14), is turned and lifted up and down through the arm (14).

Figure 4:
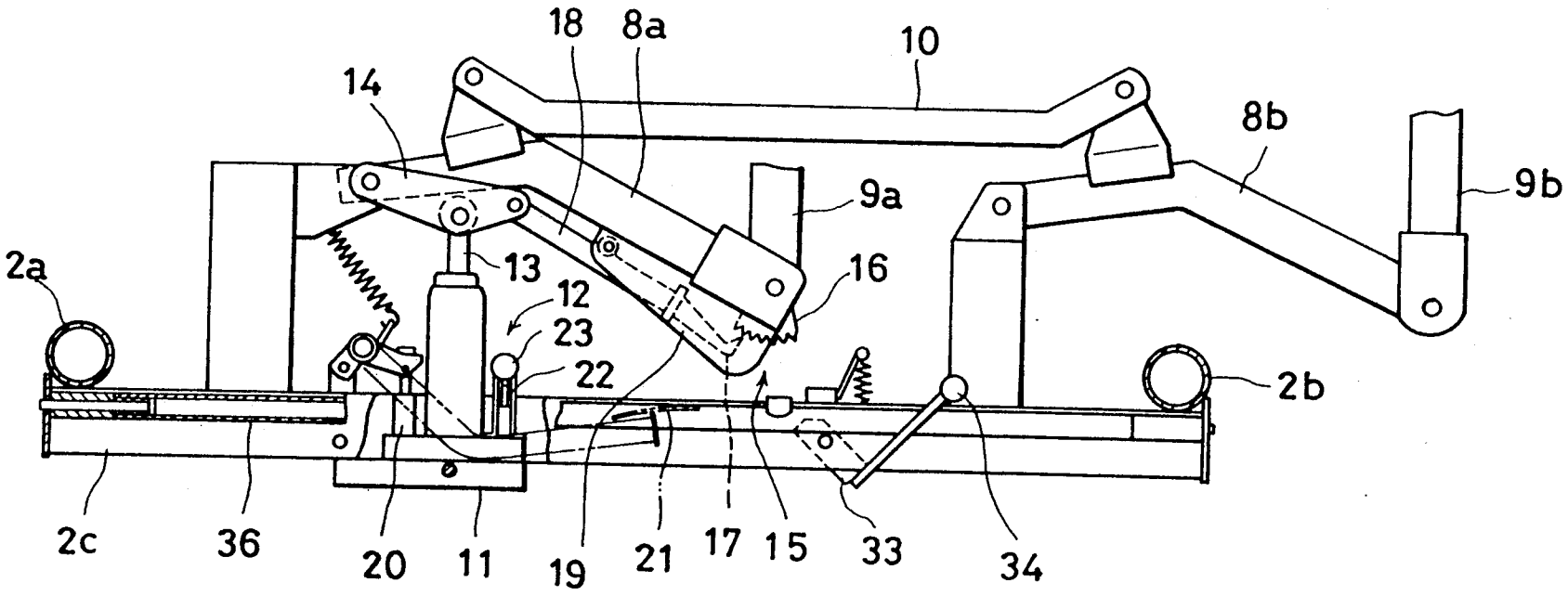
FIG. 4, is a side view revealing a section of the lifting device.

As shown in FIG. 4, (15) is a locking mechanism having a sector-shaped sawtooth gear (16) made solid with the bottom of the support lever (9*a*). A locking hook (17) interlocked with the sawtooth gear (16) is provided at the top end of a lock arm (18); the bottom end of the lock arm (18) is linked to the top end of the lifting arm (14). The middle part of the lock arm (18) is connected to a bracket (19) which is fixed onto the link (8*a*). This locking mechanism (15) prevents the truck side and bed frame (7) from dropping if the piston (13) of the jack (12) should fail. The locking principle is that when the bed frame (7) is lifted, the links (8*a*) and (8*b*) turn upward allowing a gap to the arm (14). The lock arm (18) rotates and is pulled upward on the top end of the arm (14) at its fulcrum point. Thus, the locking hook (17) is automatically interlocked with the sawtooth gear (16) to prevent turning of the link (8*a*).

Also shown in FIG. 4, (20) is the pump of the jack (12), and (21) are the foot pedals that are provided at both the right and left sides of the frame (2*c*) for operating the pump. (22) is a pressure release pin for withdrawing the piston (13) and is connected to the foot levers (23) that project at the right and left sides of the frame (2*c*).

Figure 6:
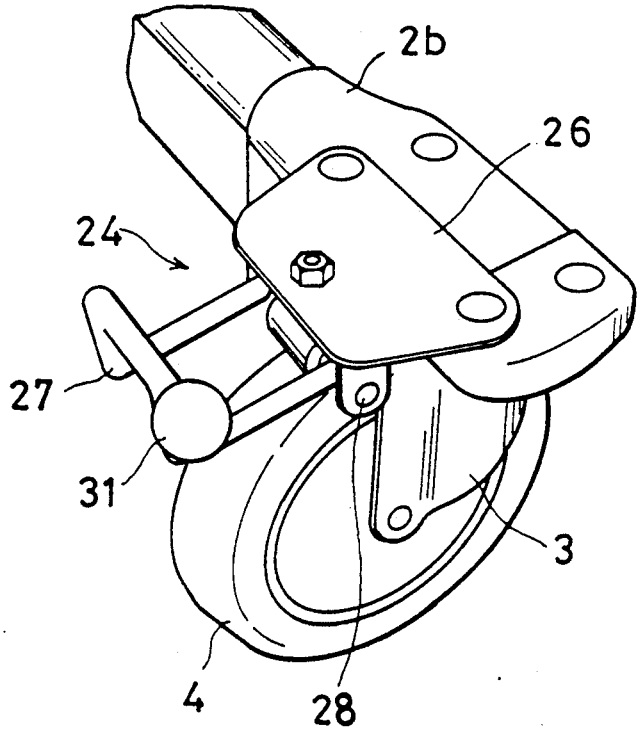
FIG. 6 and FIG. 7 are diagonal views of the wheel structure.
Figure 7:
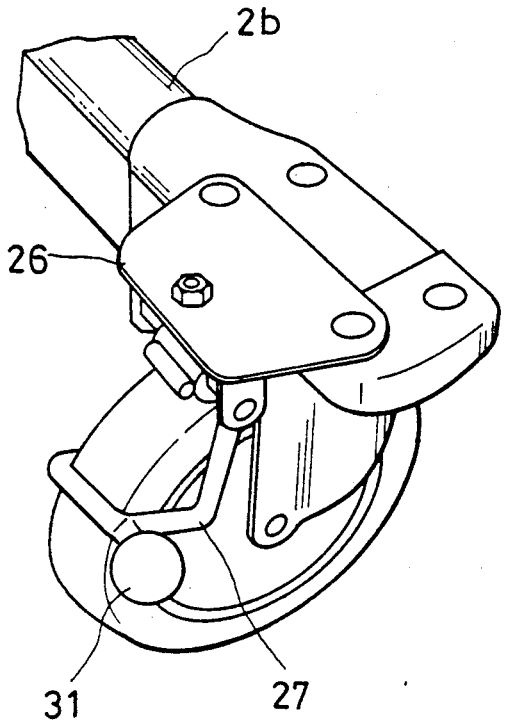
Figure 8:
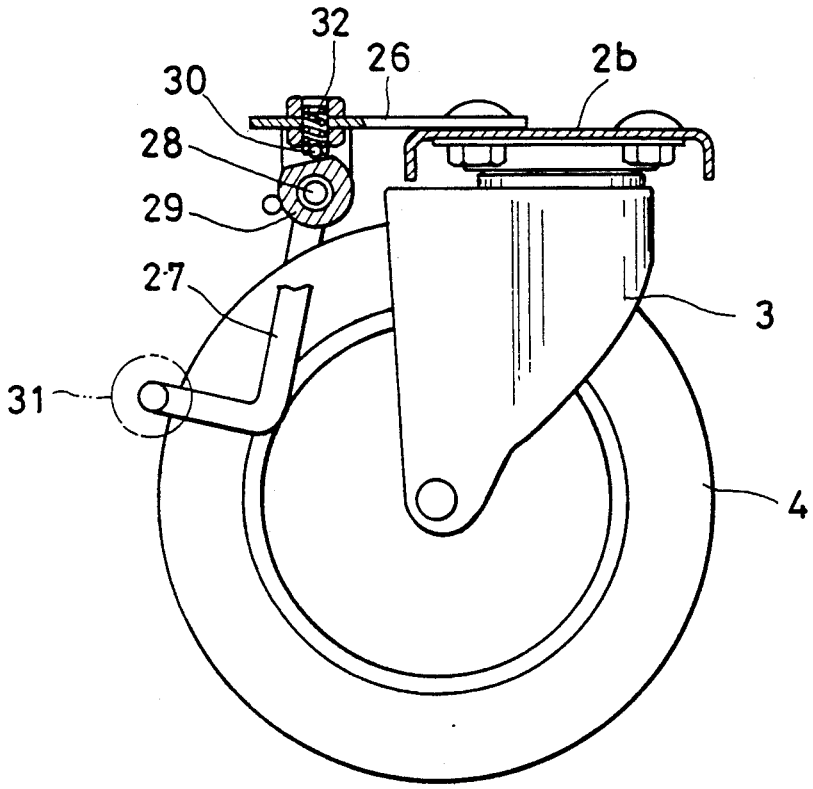
FIG. 8 is a side view of the wheel structure.

The following description is on the direction control device (24) and braking system as (25) as shown in FIG. 6, 7 and 8 for the wheels (4) attached to the movable truck (1). The wheeled stretcher can be moved freely in any direction, but normally should be moved about in a straight, forward motion only. Braking is necessary for operating the wheeled stretcher on a slope. The front and rear wheels (4) on the left side where the direction control device is located in this embodiment each have a bracket (26) provided on the front frame (2*a*) and on the rear frame (2*b*). A control frame (27), of U-shape when viewed from the top and L-shape when viewed from the side, is attached to the bracket (26) so as to be mountable and dismountable from the upper front or upper rear of the wheels (4). As shown in FIG. 8, a cam (29) is fixed to the shaft (28) to which the control frame is mounted. The bracket (26) has a ball (30) which pushes down on the cam. (31) is a control knob fixed to the control frame (27).

When the control frame (27) is kept in an up position as shown in FIG. 6, the wheel pushes down on the cam. (31) is a control knob fixed to the control frame (27).

When the control frame (27) is kept in an up position the wheel (4) can turn freely 180° to function as a caster. When the frame is pushed down as illustrated in FIG. 7, the wheel (4) cannot swing to the right or left, but can only rotate forward or backward. If the control frame (27) is pushed down from the raised non-limiting condition as shown in FIG. 6 to the control condition as shown in FIG. 7, if the wheel (4) is not directed in longitudinal direction as shown in FIG. 6 but is directed to a side, when the truck (1) is moved forward or backward, the wheel (4) pushes up against the control frame (27) on the outer periphery of the wheel (4). By the force of the moving wheel (4) forward or backward and against the spring (32), the wheel (4) is automatically fitted into the control frame (27) and the control frame (27) comes down to limiting condition as shown in FIG. 7.

Figure 5:
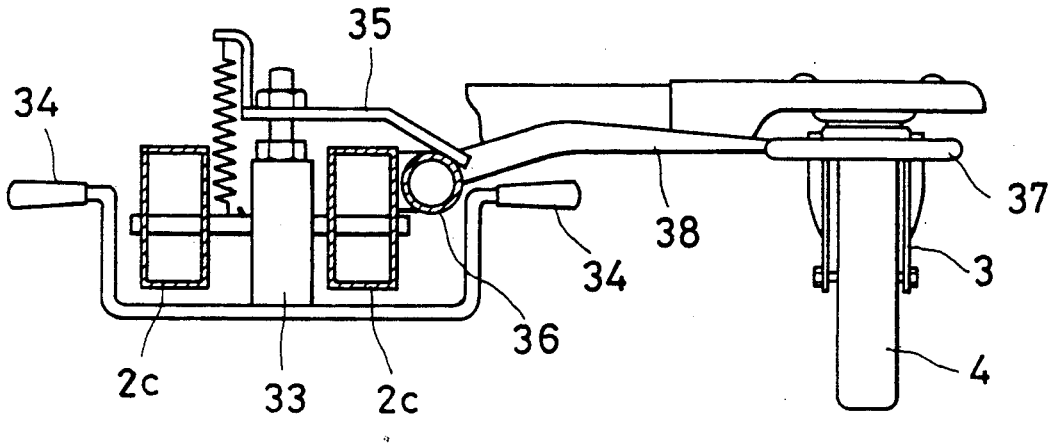
FIG. 5 is a sectional front view of the braking system.

The following is a description of the braking system (25) as illustrated in FIGS. 4 and 5. The brake is designed such that braking force is applied to the wheels (4) opposite the side with the wheels having the direction control devices (24). With regard to the structure of the braking system, a cam (33) is attached onto the longitudinal frame (2*c*) so as to be freely rotatable by operating the pedals (34) provided at the right and left sides of the frame (2*c*). An arm (35) with an adjusting bolt connected to the cam (33) is also connected to a pipe (36) provided along a side of the longitudinal frame (2*c*). The cam (33) is supported onto the frame (2*c*) so as to turn freely. A braking ring (37) is connected to the pipe (36) through a connection arm (38) so as to enclose the upper side of the front and rear left wheels (4). When the brake pedal (34) is stamped down, the braking ring (37) goes down to press against the wheels (4) on the upper face for braking.

Figure 9:
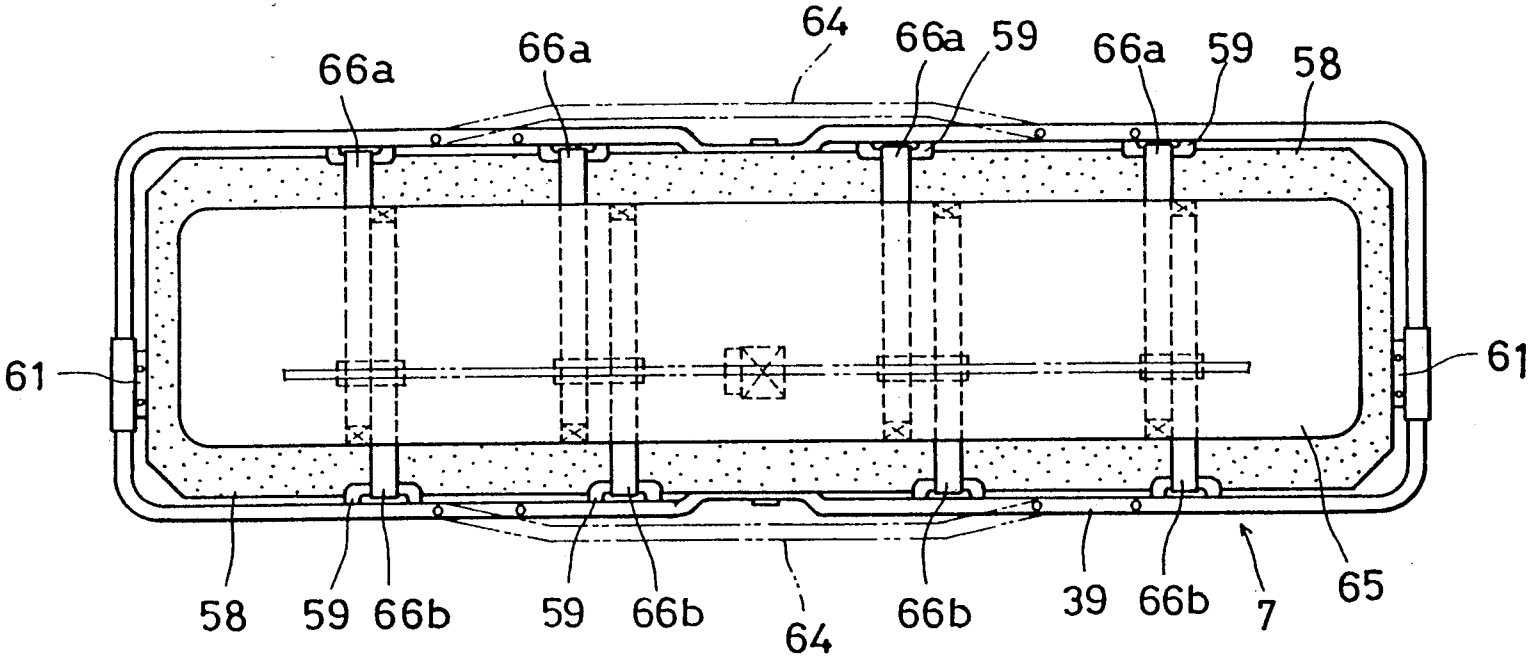
FIG. 9 is a top view of the wheeled stretcher.
Figure 10:
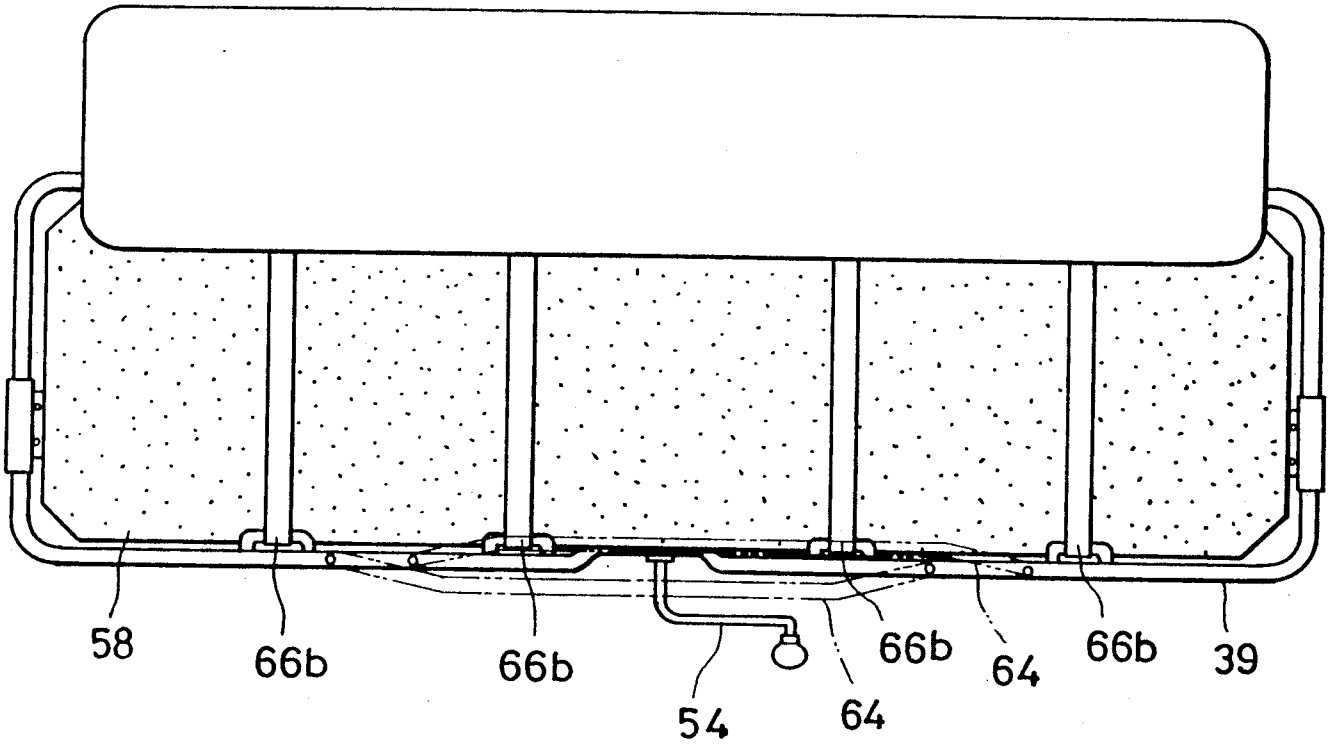
FIG. 10 is a top view with the transfer sheet moved off to one side.

As shown in FIGS. 9 and 10, the bed frame (7) is made of a pipe (39) bent in a loop shape to a rectangular top view where the right and left sides are partly bent inward at the middle in a longitudinal direction. The bent portions are left as circular pipe; all the other portions are pressed flat. A support frame (40) of U-shape when seen from a side view (FIG. 2) that runs in longitudinal direction is provided offcenter toward the left side of the bed frame (7) to connect the front end and rear end reinforcing the bed frame (7) firmly.

Figure 11:
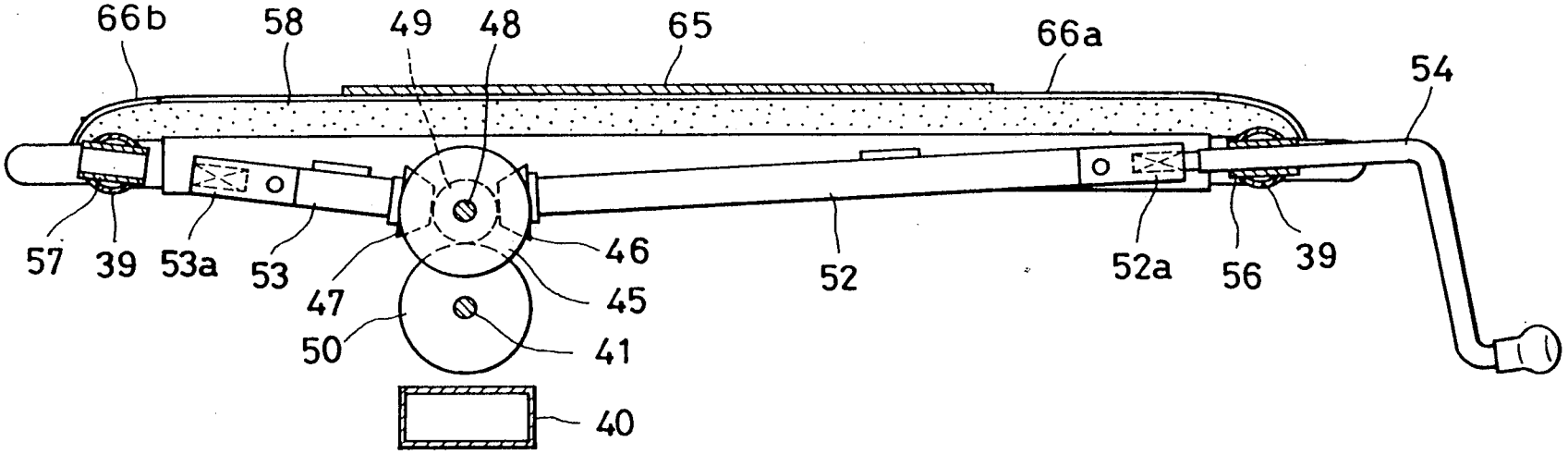
FIG. 11 is a sectional rear view of the bed frame and belt winding gear structure.
Figure 12:
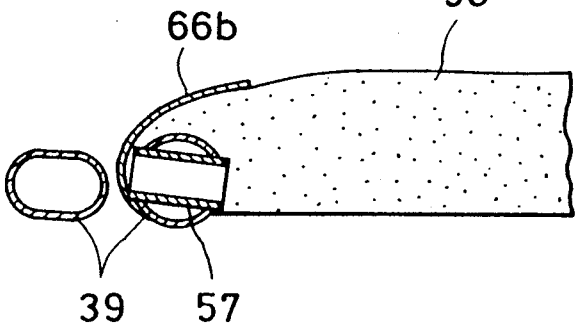
FIG. 12 is a sectional view of the bed frame and bed mat
Figure 18:
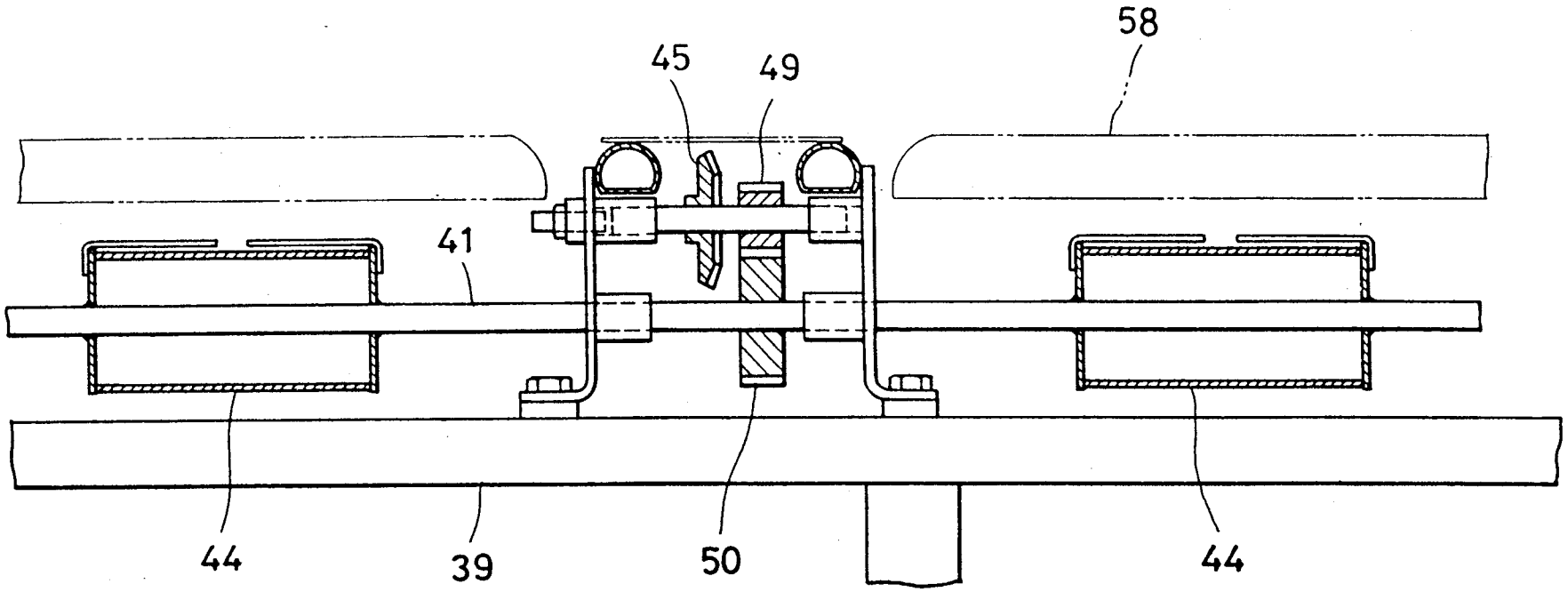
FIG. 18 is a sectional view of the belt winding gear structure.

As illustrated in FIG. 11, the cross-section of the support frame (40) is shaped square. The upper end of the support levers (9*a*, 9*b*) (See FIG. 2) are made solid with the support frame (40). (41) is a take-up shaft for winding a belt connected to the transfer sheet as will be described later. The take-up shaft (41) is located in a longitudinal direction at the top of the support frame (40), and is supported by the front and rear brackets (42, 43) which are fixed onto the support frame (40). Take-up drums (44) (See FIG. 2) which the ends of the belts are fixed are positioned along the take-up shaft (41). As shown in FIGS. 11 and 18, (45), (46) and (47) are bevel gears. Gears (49), (50) are interlocked between the support shaft (48) of the gear (45) and the take-up shaft (41). The bevel gears (46) and (47) are supported onto the support frame (40) so as to catch the bevel gear (45) from both sides. The right and left gears (46) and (47), respectively, are hung under a reinforcing plate (51) (See FIG. 2) connecting the upper face of the bent sections on the right and left sides of the bed frame (7). The shaft ends (52*a*) and (53*a*) of shafts (52) and (53), respectively, each have a square hole for accepting the square shaft at the top end of the turning handle (54) (See FIG. 11). (56), (57) are handle bearings fixed through the pipe (39).

(58) is a bed mat placed within the bed frame (7), and is fixed up to the frame pipe (39) at several points around the circumference with clips (59) (See FIG. 9). The bed mat (58) is supported by a mat holding lever (60) (See FIG. 2) which is fixed to the brackets (42) and (43), and to the reinforcing plate (51).

A gap is provided between each of the clips (59) and the pipe frame (39) through which the belt, to be described later, is fed and wound. Mat holders (61) are fixed to the front and rear extensions of the pipe frame as (39) as shown in FIG. 9. Each mat holder has holes (c) which can be used to set the handle (54) when it is out of use and to accept the pole (63) of a hanger (62) from which a bottle of intravenous fluid can be hung (See FIG. 17).

The pipe frame (39) has holes (d) on both the right and left sides into which a guard frame (64) (See FIG. 3), to prevent the person lying on the bed from falling, is inserted.

Figure 13:
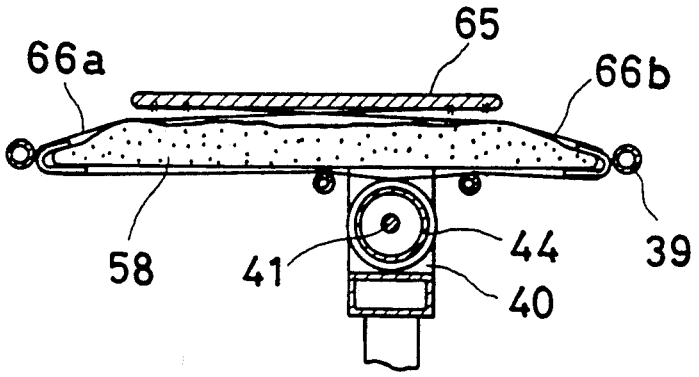
FIG. 13 is a sectional rear view of the bed frame and belt winding structure.

Transfer sheet (65) is made of synthetic resin or rubber which can be bent freely in either longitudinal or transversal direction and is placed atop the bed mat (58). As shown in FIG. 9, the bottom of the transfer sheet is attached to the top end of the belts (66*a*, 66*b*) arranged in two rows and fixed onto the take-up drums (44). In operation, the belt tension on the transfer sheet (65) is such that when one belt is wound up, the other belt is unwound when the drum (44) is turned to the right or left. Having no hard frame, the transfer sheet (65) can fit snugly under a body and can be made thin to suit varying conditions of beds and of usage. The belts go around the bed mat (58) feeding through the gap between the clip (59) and the pipe frame (39) as shown in FIG. 13. The right side belt (66*b*) is fixed to the left bottom side of the transfer sheet (65). The left side belt (66*a*) in fixed onto the right bottom side of the transfer sheet (65).

Figure 2:
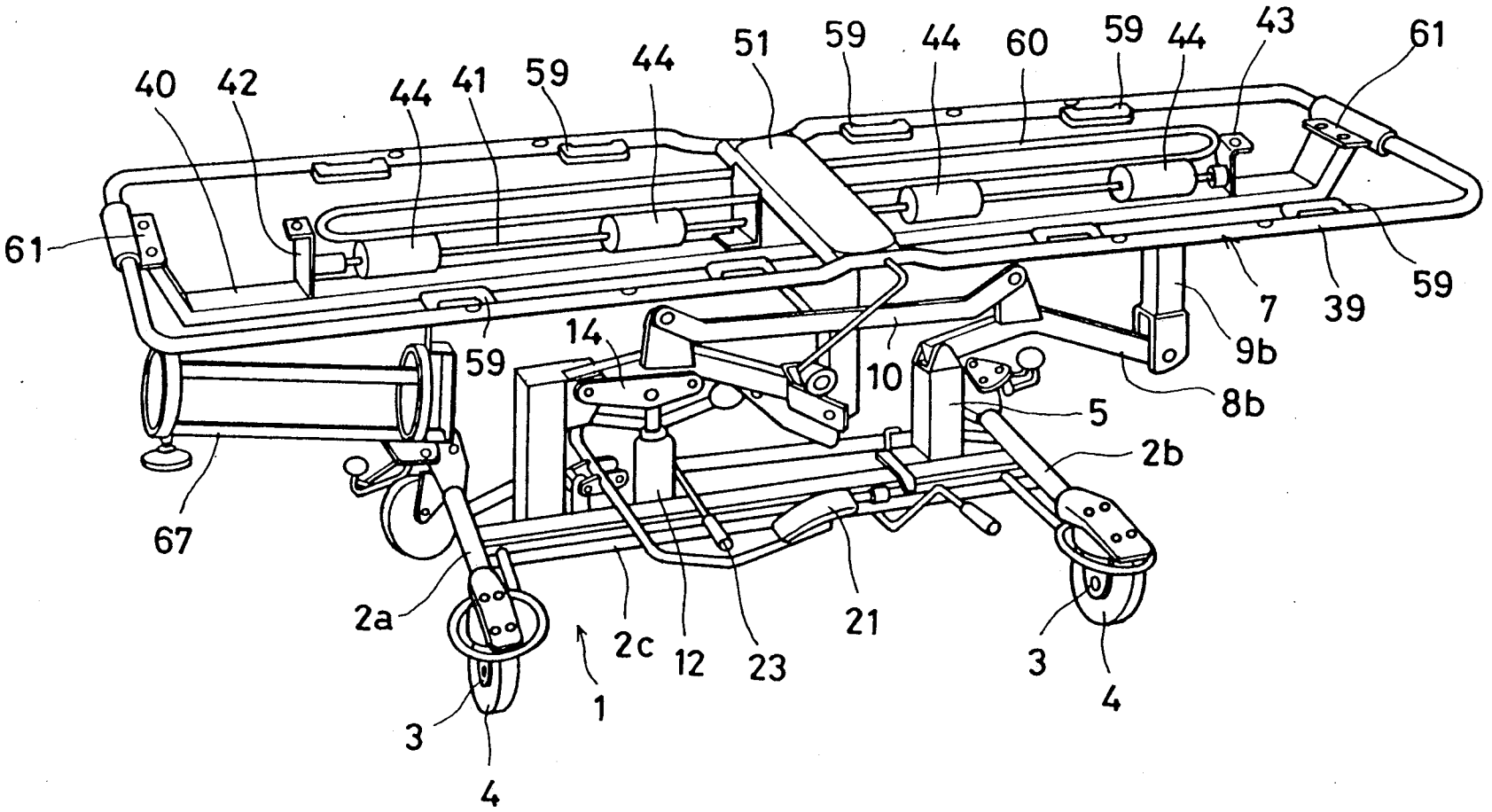
FIG. 2 is a diagonal view the stretcher without the bed mat.
Figure 3:
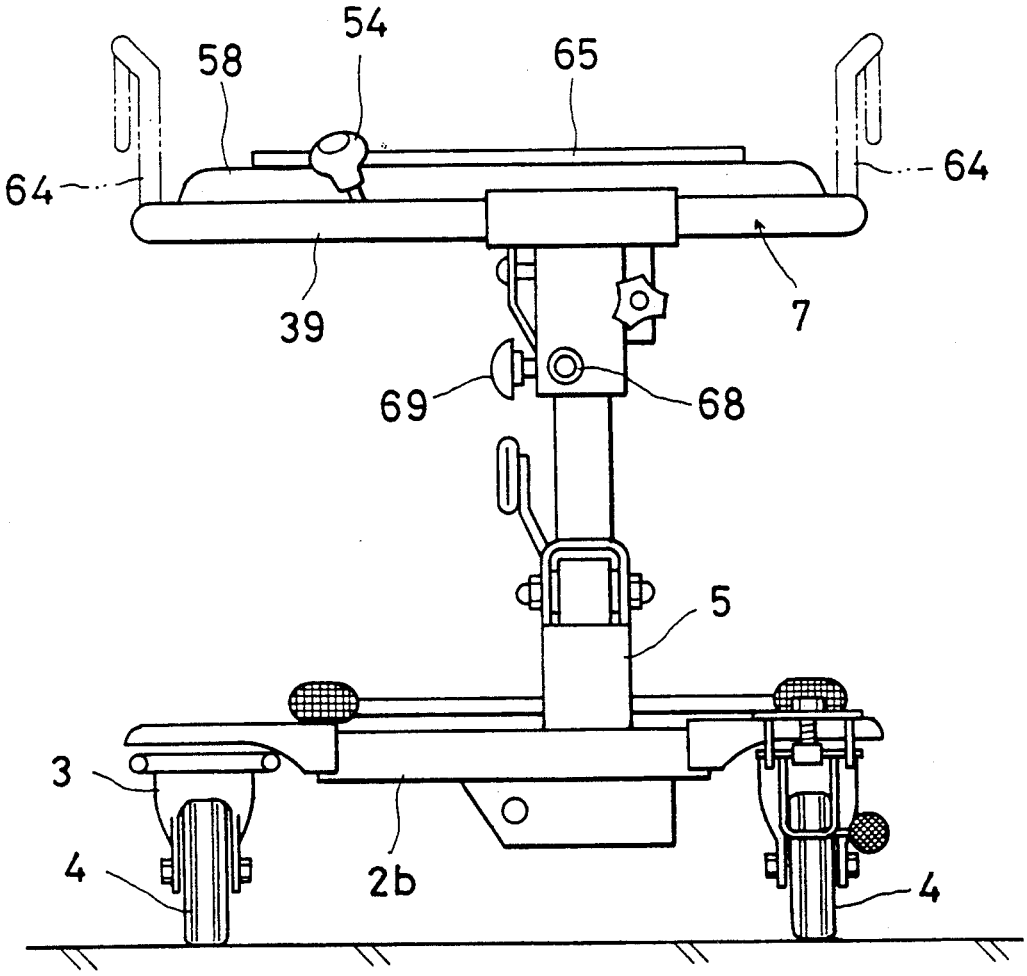
FIG. 3 is a rear view.
Figure 17:
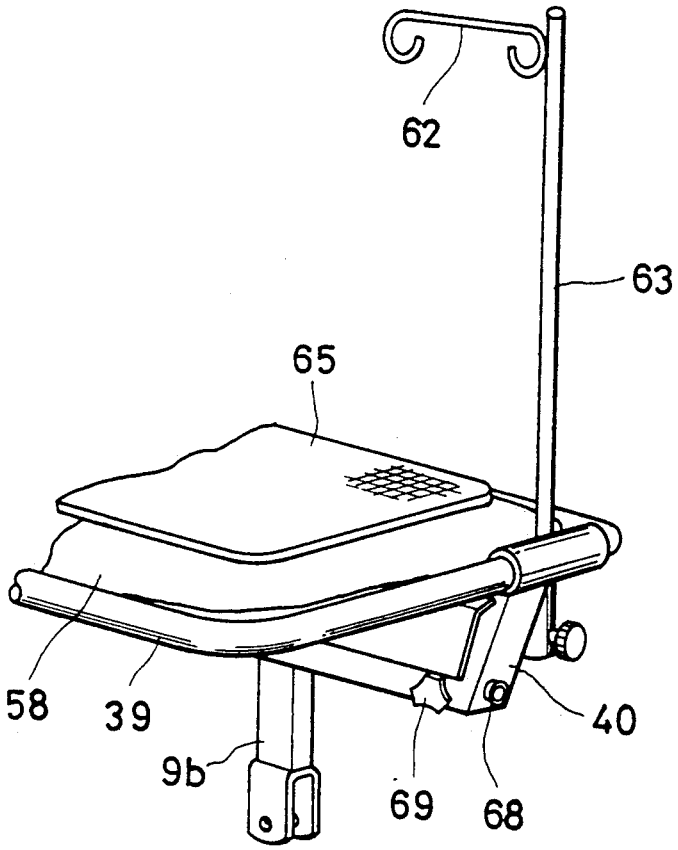

In FIGS. 1 and 2 (67) is a casing to house an oxygen cylinder. In FIGS. 3 and 17, (68) is a hole through which the hanger pole (63) of the hanger (62) is inserted into the support frame (40) when not is use. (69) is a set screw with a handle to affix the hanger pole (63) into position when housed the support frame (40).

In the operation of the above embodiment, a person (A) lying on the bed (70) such as an invalid, a physically handicapped person, or a bedridden elderly, is transferred onto the bed mat (58) on the wheeled stretcher in the following manner. First, the wheeled stretcher is placed beside the bed (70). The piston (13) of the jack (12) is elevated by stamping the pedal (21). The bed frame (7) is lifted over the surface of the bed (70) by the parallel link mechanism (6) so that the bed mat (58) is positioned just over the bed (7). The foot lever (23) is then pressed down to withdraw the piston (13) and thus lower the bed mat (58) onto the bed (7) as illustrated in FIG. 14 or FIG. 15.

In this position, the turn handle (54) for winding is then set onto the handle bearing (56) or (57) on the pipe frame (39) opposite the bed. The bevel gear (45), through bevel gears (46) or (47) is turned through the shaft (52) or (53), respectively. The take-up drum (44) connected to the take-up shaft (41) through the gears (49, 50) is turned to the right or left. The transfer sheet (65) is moved to the center of the bed (70) by the belt (66*a*) or (66*b*) at the take-up side as shown in FIG. 14 or FIG. 15. The transfer sheet (65) is placed under the back of the lying person (A) while the person is turned on his side. The turn handle (54) is turned in the opposite direction to return the transfer sheet to the middle of the bed mat (58) while carrying the person (A) on the sheet. Thus, the person lying on the bed (70) can easily be moved onto the bed mat (58) of the wheeled stretcher.

Figure 15:
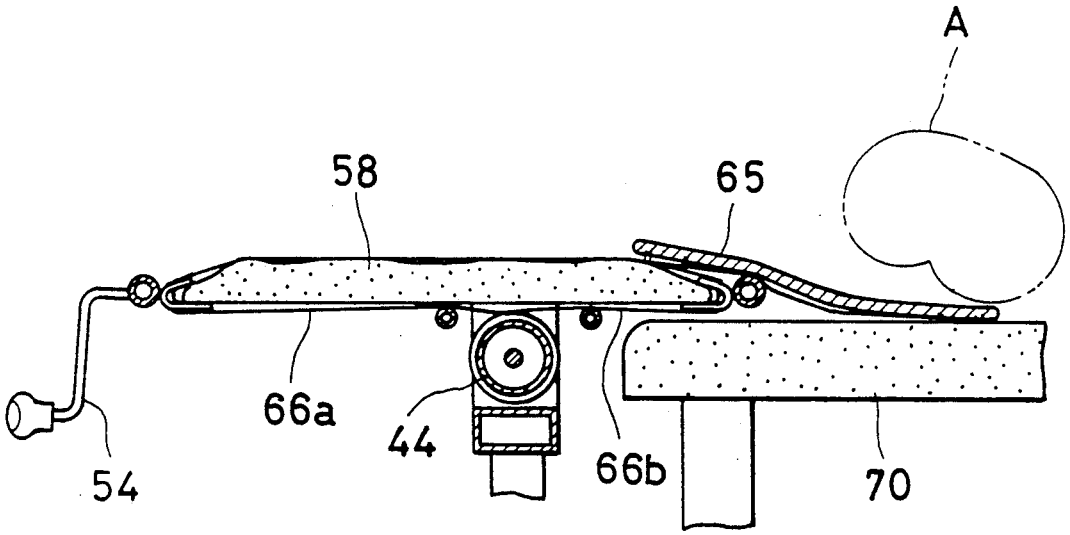
FIG. 14 and FIG. 15 are sectional rear views showing the bed frame and belt winding structure in operation.
Figure 14:
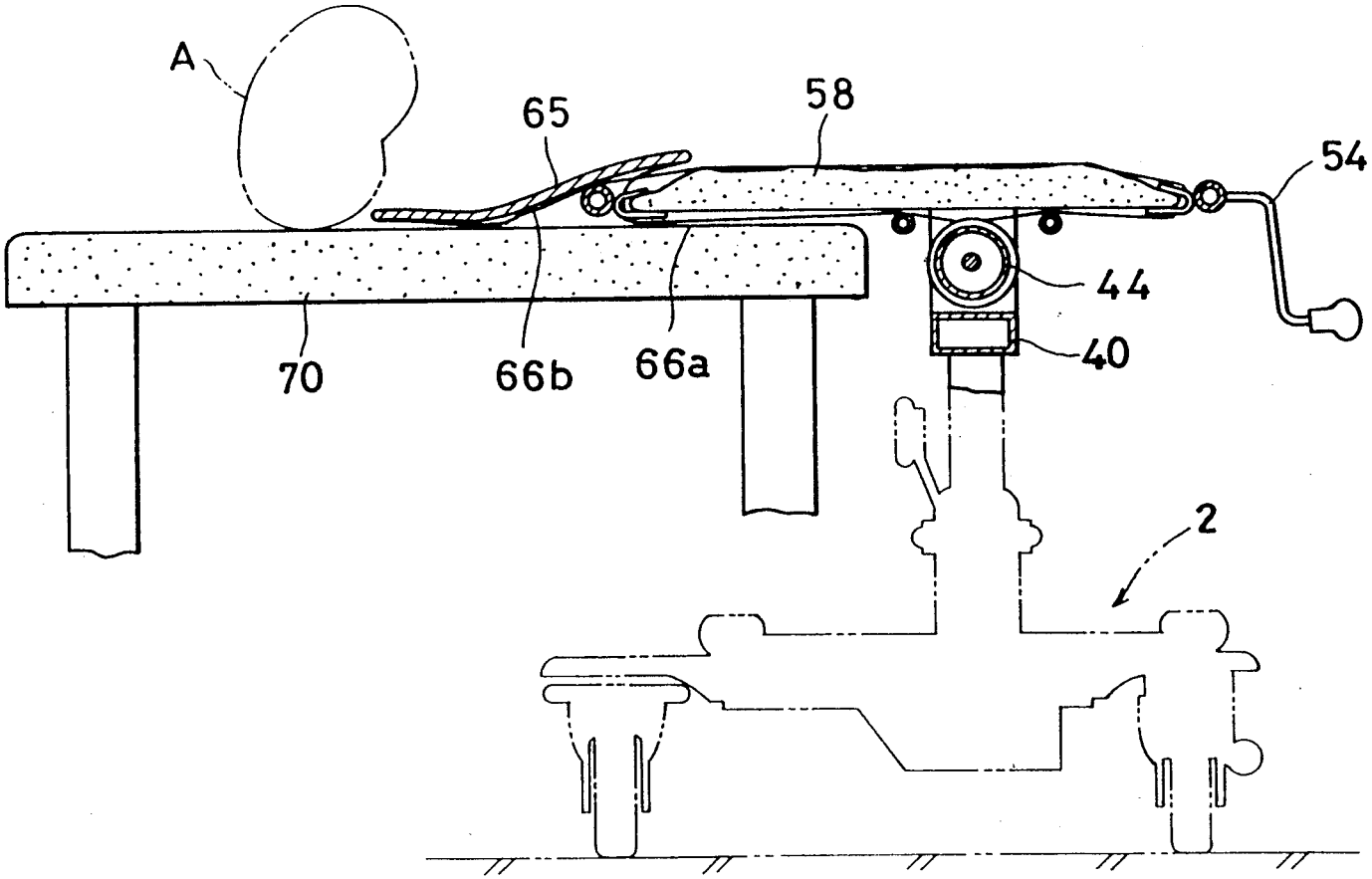
Figure 16:
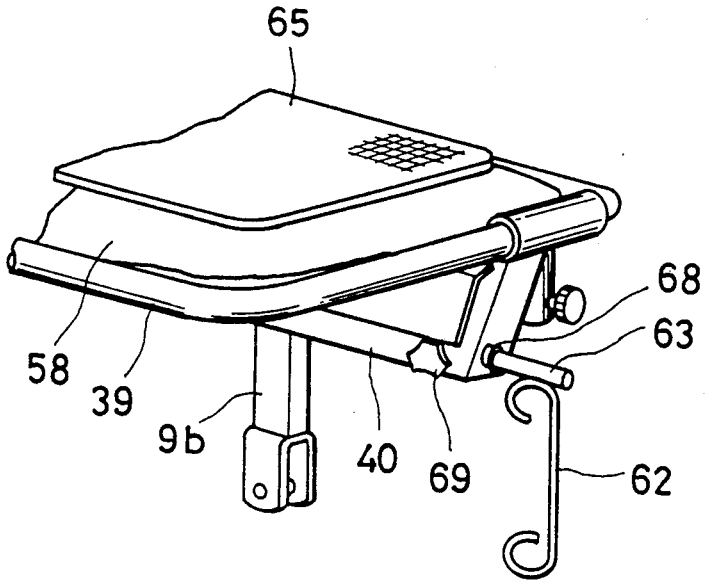
FIG. 16 and FIG. 17 are diagonal views showing the bed frame and hanger pole structure during use.

Since the lifting link mechanism (6) to support the bed frame (7) is positioned to the right or left side of the frame (7) while the width of the lifting link mechanism (6) is narrow, the bed mat (58) can be overlapped deeply with the bed from a side of the bed (70) as shown in FIG. 14 or overlapped slightly as illustrated in FIG. 15. This allows a person (A) to be transferred from either side. The lifting link mechanism (6) being deflected to the bed mat (58) in a transversal direction is very important. If the width of the bed frame (7) to accept the bed mat (58) is over 80 cm, it becomes difficult to go through the doors of hospital rooms as they are ordinarily about 90 cm. As such, the width of the bed mat cannot be made wider. To transfer a lying person (A) on the bed (70) onto the bed mat (58) from either the right or left side under this condition, it is important to overlap one side of the bed mat (58) with the bed (70) as deeply as possible for easier transfer of the person lying in the middle of the bed. If he is lying towards one of the bed, he can be transferred easily from the opposite side.

To transfer a person (A) on the bed mat (58) to the bed (70), the work can be done easily in a reverse procedure of the above. Since the person can be transferred from either the right or left side, the direction of the bed (70) being transferred to is not a significant factor.

If the bed (70) is placed close to the next bed, the bed mat (58) can be pushed in-between to transfer the person since the transversal width of the lifting link mechanism (6) is narrow.

After changing the person (A) onto the bed mat (58) as described above, it is advisable to lift the bed mat (58) slightly using the jack (12) over the surface of the bed (70) before moving the wheeled stretcher.

It is readily apparent that the above-described meets all of the objects mentioned above and also has the advantage of wide commercial utility. It should be understood that the specific form of the invention hereinabove described is intended to be representative only, as certain modifications within the scope of these teachings will be apparent to these skilled in the art.

Accordingly, reference should be made to the following claims in determining the full scope of the invention.

What is claimed is:

1. A wheeled stretcher for transferring a person to and from a bed comprising:

a truck;

a lifting device, the height of said lifting device being positionable to go under a bed, said lifting device being located at a position off center of a longitudinal centerline of said truck, and having a narrow width;

a bed frame positioned above approximately the center of said truck and supported and lifted by said lifting device;

a bed mat positioned onto said bed frame;

a transfer sheet positioned atop said mat which can be moved in a lateral direction relative to said bed frame; and at least one pair of belts, one belt of said pair of belts being connected, at one end of said one belt, adjacent to one side edge of said transfer sheet, the other belt of said pair of belts being connected, at one end of said other belt, adjacent to an opposite side edge of said transfer sheet, the opposite end of each of said belts of said pair of belts being connected, respectively, in opposite directions of rotation to a take-up drum mounted longitudinally of and intermediate the lateral edges of said bed frame for moving said transfer sheet laterally across and off of one side of said wheeled stretcher when said take-up drum is rotated in one direction and for moving said transfer sheet laterally across and off of the opposite side of said wheeled stretcher when said take-up drum is rotated in the opposite direction.

2. A wheeled stretcher according to claim 1, wherein said transfer sheet can be stretched in a lateral direction relative to said bed frame.

3. A wheeled stretcher for transferring person to and from a bed comprising:

a truck;

a lifting device mounted on said truck and located so as to be offset and adjacent to a longitudinal centerline of said truck;

a bed frame mounted on said lifting device and located substantially off-center of the longitudinal center line of said truck, said wheeled stretcher adapted for being positioned adjacent a bed whereby said bed frame can be located either adjacent to or overlapping a top surface of a bed, while said lifting device and said truck are substantially underneath the bed;

a bed mat positioned on top of said bed frame;

a transfer sheet positioned on top of said bed mat; and conveying means connected to said transfer sheet for moving said transfer sheet in a lateral direction relative to said bed frame and for moving a person on top of said transfer sheet to and from said wheeled stretcher, said conveying means including at least one pair of belts operatively connected to said transfer sheet, wherein one end of each said belt of said pair of belts is attached, respectively, adjacent to an opposite side of said sheet, said belts are fed, respectively, through a lower part of said wheeled stretcher and attached in opposite directions of rotation to a take-up drum mounted intermediate the sides of said bed frame; and belt winding means mounted on said bed frame for winding said take-up drum in opposite directions of rotation for moving said transfer sheet in opposite lateral directions to and off of opposite longitudinal sides of said bed frame.

4. A wheeled stretcher according to claim 3, wherein said transfer sheet can be stretched in a lateral direction relative to said bed frame.

5. A wheeled stretcher according to claim 3 wherein said transfer sheet is made of a plate form material which can be bent freely in at least one of a longitudinal direction and lateral direction relative to said bed frame.

6. A wheeled stretcher for transferring a person to and from a bed comprising:

a truck;

a lifting device, the height of said lifting device being positionable to go under a bed, said lifting device being located at a position off center of a longitudinal centerline of said truck, and having a narrow width;

a bed frame positioned above approximately the center of said truck, and supported and lifted by said lifting device;

a bed mat positioned onto said bed frame;

a transfer sheet positioned atop said mat which can be moved in a lateral direction relative to said bed frame, said transfer sheet being made of a plate form material which can be bent freely in either a longitudinal direction or lateral direction relative to a longitudinal centerline of said bed frame; and at least one pair of belts, one end of each belt of said pair of belts being connected at one end to said transfer sheet and at the other end, in opposite directions of rotation, to a take up drum mounted between the longitudinal sides of said bed frame for moving said transfer sheet to and beyond opposite lateral sides of said bed frame as said take-up drum is rotated in opposite directions.

7. A wheeled stretcher according to claim 6, wherein said transfer sheet can be stretched in a lateral direction relative to said bed frame.

* * * * *